United States Patent [19]

Niemeyer

[11] Patent Number: 4,674,492

[45] Date of Patent: Jun. 23, 1987

[54] ALARM SYSTEM FOR RESPIRATOR APPARATUS AND METHOD OF USE

[75] Inventor: Trenton A. Niemeyer, St. Paul, Minn.

[73] Assignee: Filcon Corporation, St. Paul, Minn.

[21] Appl. No.: 890,159

[22] Filed: Jul. 25, 1986

[51] Int. Cl.[4] ..... A62B 7/00

[52] U.S. Cl. ..... 128/202.22; 128/206.15; 128/206.17; 128/206.24; 128/206.29

[58] Field of Search ..... 128/202.22, 204.18, 128/200.24, 201.25, 206.24, 206.29, 207.16, 205.23, 206.12, 206.15, 206.17

[56] References Cited

U.S. PATENT DOCUMENTS

| | | | |
|---|---|---|---|
| 3,167,070 | 1/1965 | Silverman | 128/206.24 |
| 3,739,774 | 6/1973 | Gregory | 128/201.25 |
| 4,249,473 | 2/1981 | Pasternack et al. | 128/202.22 |

OTHER PUBLICATIONS

Brochure, "Survivair", U.S.D. Corp., 3323 West Warner Avenue, P.O. Box 25018, Santa Ana, Calif. 92799-5018, Apr. 1986.

*Primary Examiner*—Henry J. Recla

*Attorney, Agent, or Firm*—Merchant, Gould, Smith, Edell, Welter & Schmidt

[57] ABSTRACT

The alarm system of the present invention includes a pressurized air source for the purpose of pressurizing a face mask which surrounds the mouthpiece of respirator apparatus. An alarm indicating device is installed in the air line between the pressurized air source and the face mask. If the face mask is leaking air to outside the space enclosed by it, the alarm will indicate a continuous flow. If there is leakage from the space enclosed by the face mask into the mouthpiece, the alarm will indicate intermittent leakage since the placement of air will flow only during inhalation. The wearer of the apparatus may thus be confident that either no leakage is occurring or that there is leakage and that appropriate corrective measures should be taken.

10 Claims, 6 Drawing Figures

ALARM SYSTEM FOR RESPIRATOR APPARATUS AND METHOD OF USE

FIELD OF THE INVENTION

The present invention is directed to respirator apparatus and, more particularly, to respirator apparatus which includes an alarm and leak protection system. The alarm alerts the wearer of leakage so that corrective action may be taken while maintaining the leaking in a safe flow direction for a limited time.

BACKGROUND OF THE INVENTION

There are innumerable situations in various industries, such as chemical, mining, nuclear, etc., where it is not only advisable, but critical, that an air system of some type be worn by a person present in particular situations. Commonly, ambient air may be simply purified, as opposed to sources of compressed breathing air being made available to the person. In either case, there may be problems.

The basic problem with present air systems is that the configuration of the face mask or mouthpiece, which are the elements which enclose the air for breathing, do not properly conform to the configuration of an individual's face or mouth. For example, openings between the face mask and the face allow contaminated air to leak in and degrade the quality of breathable air and even create a safety hazard. With present systems, the user never knows if there is leakage.

Sometimes an individual will determine when he first puts on the face mask that there is not a good fit and corrective action is taken. Of equal concern, however, is that as the user works and perspires, frequently a mask will slip and at that time separate from the face or lips to create a leakage. In this situation, the user is oftentimes less motivated to correct the problem since he is interested in completing the work task or because he does not even perceive that leakage is occurring. Such leakage, however, even at small levels may combine with highly toxic chemicals, such as hydrogen cyanide, to severly harm the user.

As distinguished from air purifying air systems which include filters, atmosphere supplying systems tend to reduce face mask leakage because they are capable of supplying a small overpressure so that leakage is primarily outwardly. Even with these systems, however, air inspiration reduces pressure within the face mask and leakage may result. Furthermore, such systems have many drawbacks in a work environment and consequently, even though they may be somewhat safer, are less desirable. That is, respirators which have an airline between the compressed air source and the user are limited in length by federal law. Thus, mobility is limited, and tripping is always a hazard. Self contained units are heavy and tire workers rapidly. Also, the self contained units require frequent bottle changes which interrupts production, reduces efficiency and increase costs.

The present invention addresses the problem of alerting an air system user of either type when leakage is occurring so that corrective action may be taken.

SUMMARY OF THE INVENTION

The respirator apparatus of the present invention includes a filter for purifying air, mechanism for directing purified air for inhalation by the person wearing the apparatus and for directing expired air from that person, and a first mechanism for communicating the purified air from the filter to the directing mechanism. The first communicating mechanism includes a first valve mechanism for passing the purified air and preventing passage of the expired air. The apparatus also includes an outlet and a second mechanism for communicating the expired air from the directing mechanism to the outlet. The second communicating mechanism includes a second valve mechanism for passing the expired air and preventing passage of incoming contamined air. A face mask of the apparatus fits against the face of the person and surrounds the directing mechanism with respect to the face of the person. The face mask includes a mechanism for sealing to the first and second communication mechanisms which extend through the face mask to the directing mechanism. The apparatus further includes a pressurized air source and a third mechanism for communicating pressurized air from the source to the face mask. The third communicating mechanism includes an alarm mechanism for alerting the wearing person that there is flow of pressurized air. On being alerted, the person knows that there is leakage of air contained within the face mask.

In a preferred embodiment, the apparatus of the invention provides a mouthpiece for use with respect to inhaling purified air and a face mask for fitting against the wearer's face and including a slight amount of pressurized air. If the pressurized air is leaking, replacement air flows from the air source into the face mask. An alarm mechanism between the air source and the face mask alerts the wearer of the air flow so that the wearer knows there is a problem which should be corrected.

The present apparatus is particularly advantageous since a constant signal from the alarm mechanism indicates a constant leak which is most likely at the interface between the mask and the face of the person. An intermittent signal from the alarm mechanism would likely correspond with the breathing of the wearer and would indicate leakage from air enclosed by the mask into the air stream being inhaled by the wearer.

Neverthless, the important factor is that an alarm is given so that the shape of the face mask, mouthpiece or other directing mechanism can be modified to improve and correct the fit and eliminate the leakage.

Of primary importance is that the person wearing the apparatus can be confident that he is being protected by the respirator apparatus or that he knows a leak is occurring. If a leak does occur, the wearer can determine whether it is of a type which requires him to leave the area or of a type which can be fixed on site.

In this regard, it is important to note that any leakage which is signaled by the present invention is leakage of breathing quality air in a direction which does not jeopardize the user. The small source of such make up air is worn by the user and gives him plenty of time to decide if corrective action can be taken on-site or if he should leave the hazardous area.

A further advantage of the present invention has to do with the fact that any respirator system can be overbreathed. That is, the wearer can be working too hard and breathing too fast for the amount of air which the respirator system has designed to supply. When this occurs, a negative pressure exists at the mouthpiece or at the mechanism which holds air just before it is breathed. If there are any openings at the seal of such mechanism with respect to the wearer, there will be leakage and a dangerous situation could rapidly develop. The present invention would alert the wearer that he is overbreathing the system and that he must slow down and breath more normally.

These advantages and objects of the invention are be better understood by reference to the drawings, briefly described hereinafter, and the detailed description of the preferred embodiment which follows thereafter.

DETAILED DESCRIPTION OF THE PREFERRED EMBODIMENT

Figure 1:
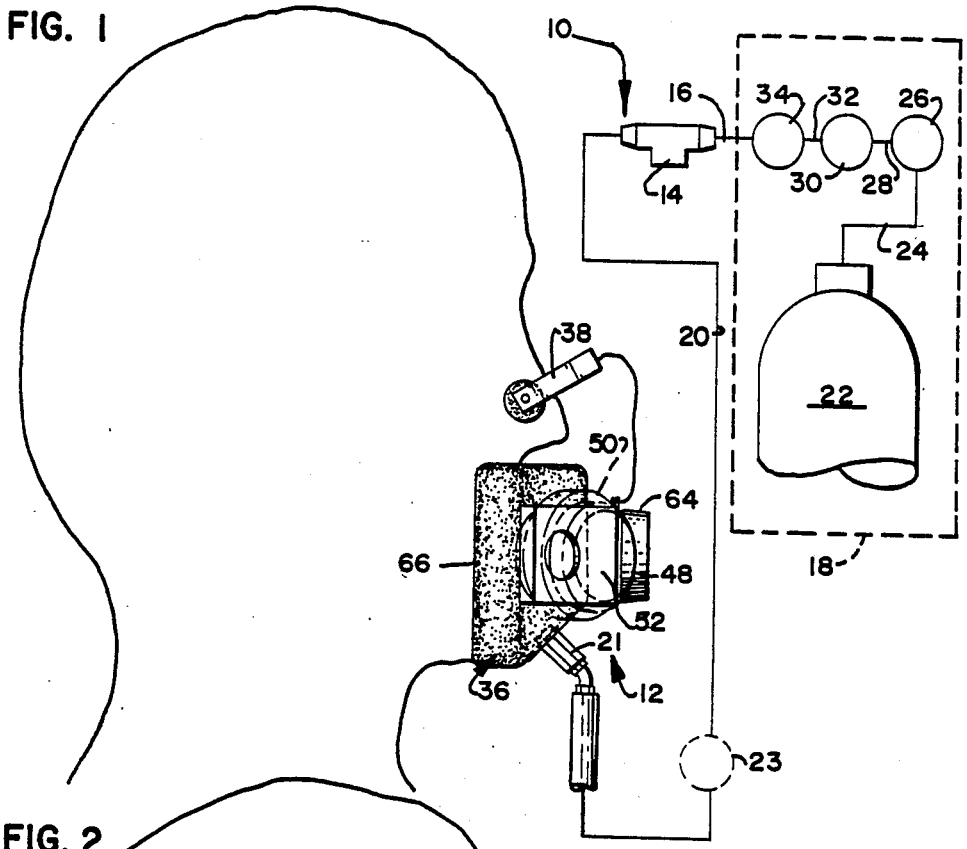
FIG. 1 is an illustration of apparatus in accordance with the present invention, showing the preferred face mask in conjunction with a nose clip.

Referring now to the drawings wherein like reference numerals designate identical or corresponding parts throughout the several views, and more particularly to FIGURE 1, an alarm system in accordance with the present invention is designated generally by the numeral 10 and is used in conjunction with a respirator apparatus 12. Alarm system 10 includes an indicating device 14 connected at its inlet end 70 via an airline 16 to a pressurized air source 18 and at its outlet end 72 via an airline 20 to face mask 36. Air source 18 is a commonly known type and may, for example, include a cannister 22 capable of holding pressurized air. The cannister is in fluid communication as depicted at airline 24 to a valve 26. The outlet of valve 26 is connected at line 28 to an optional low pressure alarm 30 which is connected at line 32 to a regulator 34. An optional additional regulator 23 may also be installed in line 20 to provide pressure control independent of source 18.

The respirator apparatus 12 of FIG. 1 is shown with quarter mask 36 which fits against the face of the wearer and covers his mouth, but not his nose. A nose plug 38 is used to plug the wearer's nose. Nose plug 38 is connected with a short line to apparatus 12 so that it will not be lost when not in use.

Figure 2:
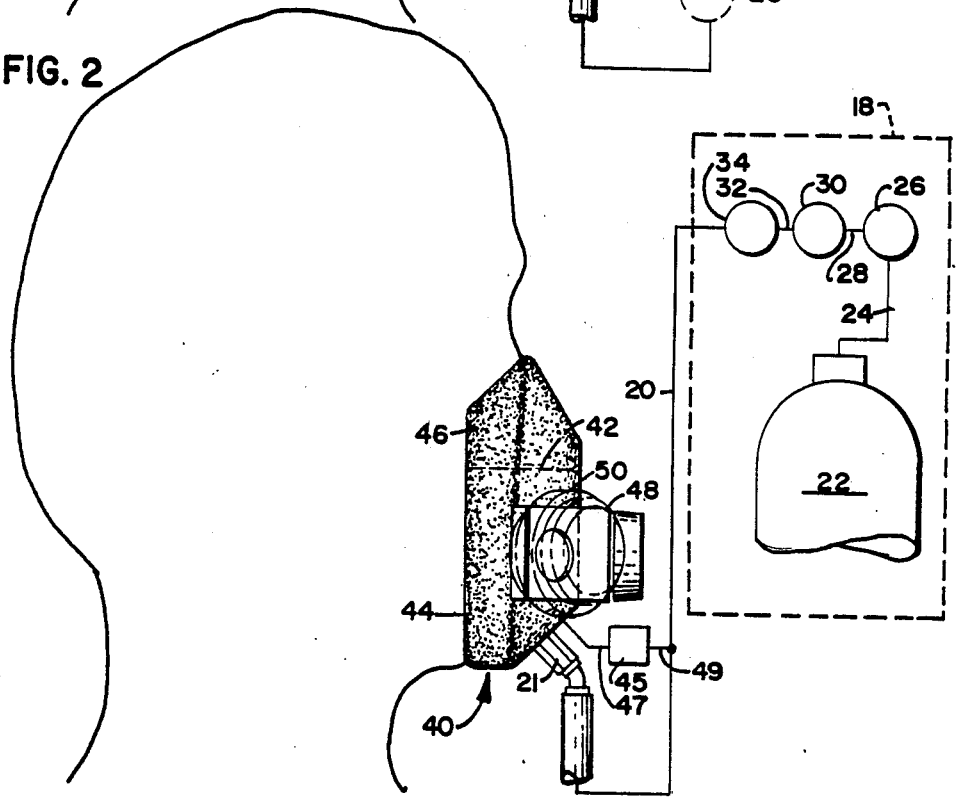
FIG. 2 is an illustration similar to FIG. 1, but showing an alternate type of face mask.

The respirator apparatus shown in FIG. 2 is the same as that shown in FIG. 1, except the indicating device 45 is a differential pressure type and the face mask 40 is a half face type which covers not only the wearer's mouth, but also his nose. Mask 40, however, includes a separating partition 42 to separate space enclosed by face mask 40 into a first region 44 which surrounds the wearer's mouth and a second region 46 which surrounds the wearer's nose. First region 44 functions in a fashion similar to quarter face mask 36, described in more detail hereinafter. Second region 46 is simply an enclosed region without an air supply so as to prevent breathing through the nose. Face mask 40 may be used with or without a nose plug, such as 38.

The differential pressure sensing device represented by indicating device 45 is conventional and may show a value on a meter or readout or may be connected to additional items for an aural signal. Device 45 is in fluid communication with first region 44 through line 47 and with line 20 upstream from check valve 21 with line 49.

Figure 4:
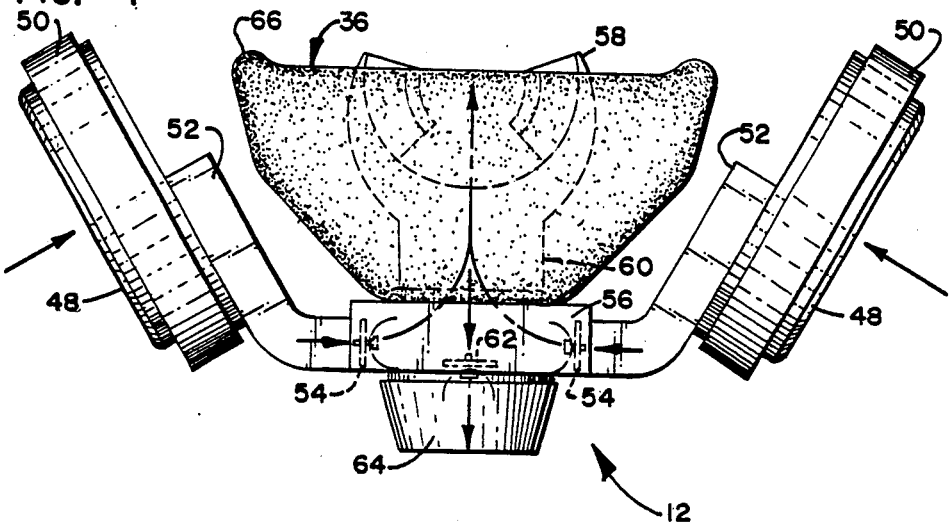
FIG. 4 is a plan view of a respirator device, showing valves in broken lines.

Respirator apparatus 12 is shown in plan view in FIG. 4. Apparatus 12 includes a pair of filters 48. Filters 48 are held in an appropriate frame mechansim 50 and each is in fluid communication with a conduit 52. A valve mechanism 54 allows purified incoming air to enter a common portion 56 from where purified air flows into mouthpiece 58 and may be inhaled. During exhalation, valves 54 close and expired air flows from mouthpiece 58 through fluid communicating space 60, including common portion 56, to valve mechanism 62 and outlet 64. The particular configuration of apparatus 12 is not important to the present invention, and it is understood that various other configurations are equally applicable to the present invention.

Of importance is that a face mask, such as mask 36 is attached to and cooperates with apparatus 12. Face mask 36 fits about and is sealed to the common portion 56 of apparatus 12. In this way, face mask 36 encircles mouthpiece Face mask 36 encloses a space surrounding mouthpiece 58 thereby defining a space which may be monitored for leakage with respect to the flow paths of respirator apparatus 12. As indicated in FIG. 1, air source 18 is in fluid communication with face mask 36. Depending on the regulated pressure at regulator 34 (or optional regulator 23), an air pressure builds within the space enclosed by face mask 36. Preferably the overpressure in face mask 36 is about one and one half to two inches of water column. Once the overpressure builds to that level, the check valve 21 holds it unless there is leakage. If there is leakage at any point along edge 66 of face mask 36, some of the pressurized air will escape which will require a flow of air from air source 18. Such flow of air will be detected by indicating device 14 which will alert the person wearing the apparatus. In like fashion, if there is a leak between mouthpiece 58 and the wearer's lips, pressurized air within mask 36 will leak intermittently into mouthpiece 58 when the wearer is inhaling. Again, the air will have to be replenished within face mask 36 at intermittent times when it is inhaled. Indicating device 14 will then signal intermittent flow.

Figure 3:
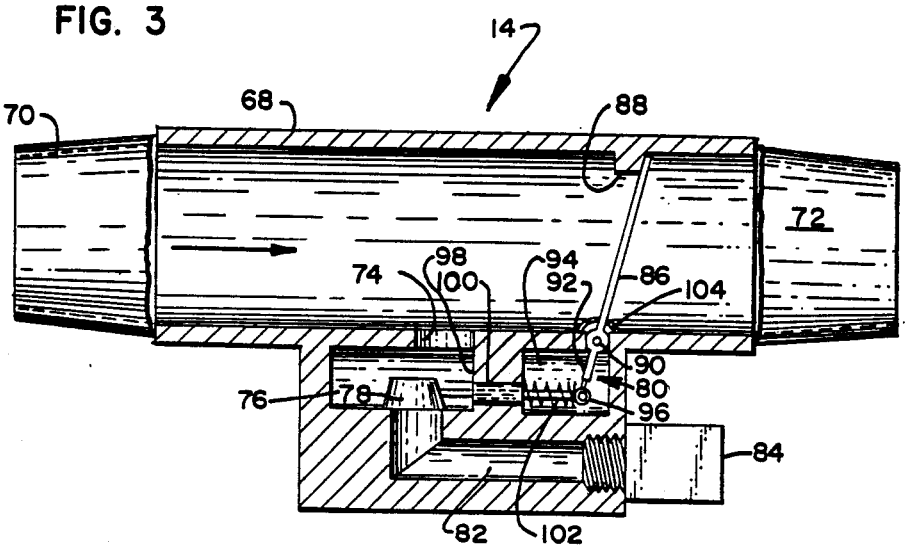
FIG. 3 is a cross-sectional view of an alarm indicating device.

A representative alarm indicating device 14 is shown in FIG. 3. Indicating device 14 includes a main conduit 68 having an inlet end 70 and an outlet end 72. Conduit 68 includes an opening 74 in its wall leading to an enclosure 76 within which slide stop 78 is positioned. Slide stop 78 functions as a part of a valve mechanism 80. Slide stop 78 opens or closes fluid communication with passageway 82 leading to a sound indicating device 84, such as a whistle.

Valve mechanism 80 includes a flap 86 which substantially stops flow in conduit 68, when it is positioned against nub 88. Flap 86 is held by a pin 90 opposite nub 88 in the wall of conduit 68 and pivots about pin 90. A tang 92 on the other side of pin 90 from flap 86 extends into enclosure 94 and is connected to link 96. The other end of link 96 is attached to slide stop 78. Enclosures 76 and 94 are separated by a wall 98 having a passageway with a seal 100 therein which seals between link 96 and wall 98 to prevent air from flowing from enclosure 76 into enclosure 94. A spring 102 biases flap 86 against nub 88 and slide stop 78 in the closed position. A flexible boot 104 seals flap 86 at its pivot 90 with respect to enclosure 94.

When air flows through indicating device 14 from inlet end 70 to outlet end 72, flap 86 pivots so that spring 102 is compressed and slide stop 78 is moved to open passageway 82. In this way, some of the flowing air flows through opening 74, enclosure 76 and passageway 82 to device 84 which provides, in this case, a sound signal. When flow stops, spring 102 forces flap 86 to pivot back against nub 88. At the same time, slide stop 78 moves to close passageway 82 and the sound signal ceases.

An alternative indicating device 45 is indicated in FIG. 2. It is understood, also, that other devices may serve as appropriate sensors and be configured to provide the desired alarm.

Figure 5:
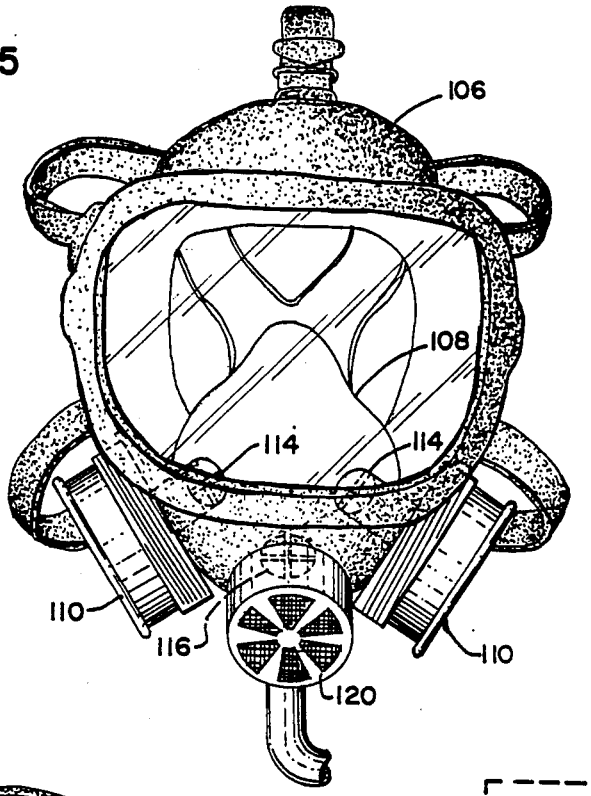
FIG. 5 is the front view of a different type of respirator, and another alternate face mask.
Figure 6:
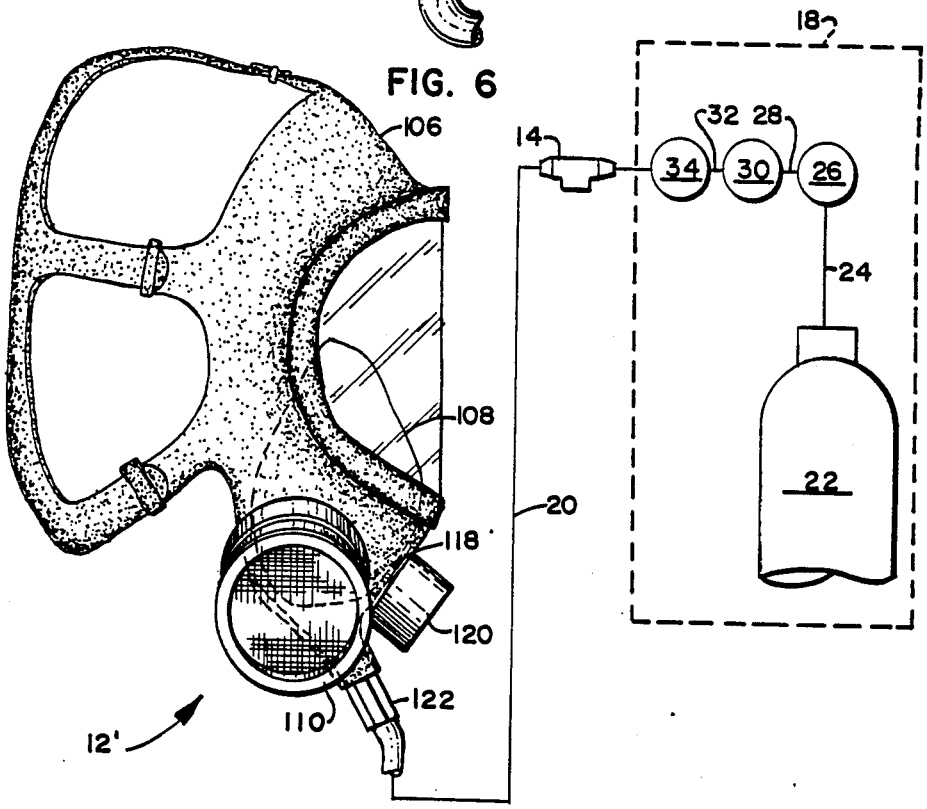
FIG. 6 is an illustration of the alarm device in accordance with the present invention in conjunction with the respirator of face mask of FIG. 5.

An additional embodiment of the present invention is shown in FIGS. 5 and 6. Alarm indicating device 14 and air source 18 are the same as those previously described. The respirator apparatus, however, designated as 12', and the face mask 106 differ from those described hereinabove. Apparatus 12' includes a half face mask 108 instead of a mouthpiece for directing incoming purified air and outgoing expired air. A pair of filters 110 are in fluid communication with conduits 112 which extend through full face mask 106 and half face mask 108 to communicate purified air into the enclosure enclosed by half face mask 108. Valve mechanisms 114 allow purified air into half face mask 108 and prevent expired air from entering conduits 112. Expired air passes from half face mask 108 through valve mechanism 116 and conduit 118 to outlet 120. Full face mask 106 completely encloses half face mask 108 and seals against the head of the person wearing the apparatus. Full face mask 106 also seals around conduits 112 and 118 so as to hold a slight pressure over ambient within space enclosed by it. As shown at connection 122 of airline 20 to full face mask 106, pressurized air from air source 18 fills the space between full face mask 106 and half face mask 108. As with the other embodiments, a leakage of the pressurized air either out of face mask 106 to ambient or into half face mask 108 results in air flow from air source 18 and an alarm from indicating device 14.

In use, a person puts on the apparatus so that he may breathe. That is, purified air flows from filters 48 through conduits 52 and valve mechanisms 56 into common portion 56 and conduit 60 before reaching mouthpiece 58. Expired air flows from mouthpiece 58 through conduits 60 and common portion 56 to valve 62 and outlet 64. In order to give the wearer confidence that there is no leakage at mouthpiece 58 or at the edge 66 of face mask 36, the valve 26 of air source 18 is opened. Air flows into face mask 36 to the pressure as regulated by regulator 34. After pressurization, the wearer listens for a signal from alarm indicating device 14 to determine whether there is continuing flow of pressurized air thereby signaling a leakage of air. In this regard, the wearer must discern between a constant signal which signals leakage from space enclosed by face mask 36 to space outside of face mask 36 and an intermittent signal which signals inhalation of pressurized air and therefore leakage from the space between face mask 36 and mouthpiece 58 into mouthpiece 58. If leakage is signaled, the wearer must decide whether to take action to stop the leakage and, therefore, the signal from the alarm indicator device 14. Such action may be no more than an adjustment of the face mask for a better fit, or an adjustment of the mouthpiece to make a better seal against the lips of the person. On the other hand, the mask may be too big or otherwise unmatchable to the wearer's face. In like fashion, the mouthpiece may not fit the wearer's mouth due to teeth or lip or other facial configuration. In this case, depending on the material or gas which is being filtered from the air before breathing, the wearer may decide to leave the area, reform the sealing surface or take other safety steps.

The present invention has, thus, been disclosed in detail, and the advantages of structure and function pointed out. The disclosure is understood, however, to be exemplary. In this regard, then, it is understood that any changes made, especially in matters of shape, size and arrangement of elements to the full extent extended by the general meaning of the terms in which the appended claims are expressed, are within the principle of the invention.

What is claimed is:

1. Respirator apparatus for a person, comprising:
a filter for purifying ambient air;
means for directing purified air for inhalation by said person and for directing expired air from said person;
first means for communicating the purified air from said filter to said directing means, said first communicating means including first valve means for passing said purified air and preventing passage of said expired air;
an outlet;
second means for communicating the expired air from said directing means to said outlet, said second communicating means including second valve means for passing said expired air and preventing passage of incoming contamined air;
a face mask for fitting against the face of said person and surrounding said directing means with respect to the face of said person, said face mask including means for sealing to said first and second communication means which extend through said face mask to said directing means;
a pressurized air source; and
third means for communicating the pressurized air from said source to said face mask, said third communicating means including alarm means for alerting said person that there is flow of pressurized air;
whereby on being alerted said person may conclude there is leakage of pressurized air from said face mask.

2. Apparatus in accordance with claim 1 wherein said directing means includes a mouthpiece and said first and second communication means include a common portion leading to said mouthpiece, said face mask fitting about said common portion; said sealing means sealing said face mask about said common portion.

3. Apparatus in accordance with claim 1 including means for plugging the nose of said person.

4. Apparatus in accordance with claim 1 wherein said directing means includes a mouthpiece and said face mask includes a partition for separating space enclosed by said face mask into a first region which surrounds said person's mouth and a second region which surrounds said person's nose.

5. Apparatus in accordance with claim 1 wherein said directing means includes a half mask which fits within said face mask, said half mask for fitting over the mouth of said person.

6. Apparatus in accordance with claim 1 wherein said alarm means includes means for making a sound which can be heard by said person.

7. Apparatus in accordance with claim 1 wherein said alarm means includes means for making a visual readout which can be read by a person.

8. Respirator apparatus for a person, comprising:

a filter for purifying air;

a mouthpiece;

first means for communicating purified air from said filter to said mouthpiece, said first communicating means including first valve means for passing said purified air and preventing passage of expired air;

an outlet;

second means for communicating said expired air from said mouthpiece to said outlet, said second communicating means including second valve means for passing said expired air and preventing passage of said purified air;

a face mask for fitting against the face of said person and surrounding said mouthpiece with respect to the face of said person, said first and second communcating means passing through said face mask;

a pressurized air source; and third means for communicating pressurized air from said air source to said face mask, said third communicating means including alarm means for alerting said person that there is leakage of pressurized air from said face mask, said alarm means including means for providing a constant signal for leakage from space enclosed by said face mask to outside space, and an intermittent signal for pressurized air inspired by said person.

9. A method for a person for using respirator apparatus, said respirator apparatus including a filter for purifying air, means for directing purified air for inhalation by said person and for directing expired air from said person, and first means for communicating purified air from said filter to said directing means, said apparatus further including an outlet and second means for communicating expired air from said directing means to said outlet, said apparatus also including a face mask for fitting against the face of said person and surrounding said directing means with respect to the face of said person, a pressurized air source, and third means for communicating pressurized air from said source to said face mask, said third communicating means including alarm means for alerting said person that there is flow of pressurized air, said method comprising the steps of:

putting said apparatus on said person so that said person may breathe in through said filter, first communicvating means and directing means and out through said directing means, second communicating means and outlet;

turning on said air source so that pressurized air flows through said third communicating means to pressurize said face mask;

sensing for a signal from said alarm means to determine whether there is flow of pressurized air thereby signaling leakage; and stopping said leakage so that said signal from said alarm means stops.

10. The method of claim 8 wherein said sensing step includes discerning between a constant signal which signals leakage from space enclosed by said face mask to space outside of said face mask from an intermittent signal which signals inhalation of pressurized air, and wherein said leakage stopping step includes one of adjusting said face mask for a better fit to the face of said person to stop a constant signal and adjusting said mouthpiece with respect to his jaw for making a better seal against the lips of said person to stop inhalation of air enclosed by said face mask.

* * * * *